US008186971B2

(12) United States Patent
Sato et al.

(10) Patent No.: US 8,186,971 B2
(45) Date of Patent: May 29, 2012

(54) MULTISTAGE COMPRESSOR HAVING AN OIL SEPARATOR PLATE

(75) Inventors: Hajime Sato, Aichi (JP); Yoshiyuki Kimata, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 556 days.

(21) Appl. No.: 12/441,803

(22) PCT Filed: Aug. 15, 2008

(86) PCT No.: PCT/JP2008/064643

§ 371 (c)(1),
(2), (4) Date: Mar. 18, 2009

(87) PCT Pub. No.: WO2009/025244

PCT Pub. Date: Feb. 26, 2009

(65) Prior Publication Data

US 2010/0083690 A1 Apr. 8, 2010

(30) Foreign Application Priority Data

Aug. 17, 2007 (JP) ..... 2007-212757

(51) Int. Cl.
*F04B 17/00* (2006.01)
*F04C 18/02* (2006.01)

(52) U.S. Cl. ..... 417/321; 417/410.5; 418/11

(58) Field of Classification Search ..... 417/321, 417/228, 245, 410.5; 418/11, 55.1, 60, 97
See application file for complete search history.

(56) References Cited

FOREIGN PATENT DOCUMENTS

| | | | |
|---|---|---|---|
| JP | 49-70506 | U | 6/1974 |
| JP | 53-85513 | A | 7/1978 |
| JP | 61-144277 | U | 9/1986 |
| JP | 05-087074 | A | 4/1993 |
| JP | 9-250477 | A | 9/1997 |
| JP | 2002-317775 | A | 10/2002 |
| JP | 2005-344537 | A | 12/2005 |

OTHER PUBLICATIONS

International Search Report of PCT/JP2008/064643, date of mailing dated Nov. 18, 2008.
Office Action issued on Feb. 7, 2012 for corresponding Japanese Patent Application No. 2007-212757.

*Primary Examiner* — Joseph L Williams
(74) *Attorney, Agent, or Firm* — Westerman, Hattori, Daniels & Adrian, LLP

(57) ABSTRACT

A multistage compressor is provided, which can reduce an oil circulation ratio by reducing the amount of lubricating oil to be taken in by a high-stage compression mechanism to improve the system efficiency and prevent a shortage of lubricating oil. A low-stage compression mechanism and a high-stage compression mechanism are disposed below and above to flank an electric motor, respectively, intermediate-pressure refrigerant gas compressed by the low-stage compression mechanism is discharged into a sealed housing, and the intermediate-pressure refrigerant gas is taken in by the high-stage compression mechanism so as to be compressed in two stages, an oil separator plate that centrifugally separates lubricating oil contained in the intermediate-pressure refrigerant gas, which is taken in by the high-stage compression mechanism after passing through the electric motor, is provided at one end of a rotor of the electric motor such that a rotary shaft extends through the oil separator plate.

12 Claims, 10 Drawing Sheets

MULTISTAGE COMPRESSOR HAVING AN OIL SEPARATOR PLATE

TECHNICAL FIELD

The present invention relates to a multistage compressor having a low-stage compression mechanism and a high-stage compression mechanism that are provided within a sealed housing and are driven by an electric motor.

BACKGROUND ART

Patent Document 1 discusses an example of a multistage compressor having a low-stage compression mechanism and a high-stage compression mechanism that are provided within a sealed housing and are driven by an electric motor. In this multistage compressor, the electric motor is disposed in a substantially central section inside the sealed housing, and a low-stage rotary compression mechanism is disposed below the electric motor, whereas a high-stage scroll compression mechanism is disposed above the electric motor. Moreover, the low-stage rotary compression mechanism and the high-stage scroll compression mechanism are driven by the electric motor via a rotary shaft.

The aforementioned multistage compressor is configured to take low-temperature refrigerant gas from a refrigeration cycle side into the low-stage rotary compression mechanism through an intake pipe, compress the refrigerant gas to intermediate pressure, discharge the intermediate-pressure refrigerant gas temporarily into the sealed housing, take the intermediate-pressure refrigerant gas into the high-stage scroll compression mechanism so as to compress the refrigerant gas to a high-temperature high-pressure state in two stages, and then discharge the refrigerant gas to the outside through a discharge pipe; hence, the inside of the sealed housing is in an intermediate-pressure refrigerant-gas atmosphere.

Patent Document 1:

Japanese Unexamined Patent Application, Publication No. Hei 5-87074

DISCLOSURE OF INVENTION

In the aforementioned multistage compressor, the intermediate-pressure refrigerant gas discharged into the sealed housing is merged with a large amount of lubricating oil that is discharged into the sealed housing together with the refrigerant gas after being used for lubricating the low-stage rotary compression mechanism or a large amount of lubricating oil dripping down along the sealed housing from the high-stage scroll compression mechanism after being used for lubricating the high-stage scroll compression mechanism; this implies that the intermediate-pressure refrigerant gas is in an oil-rich state. While this intermediate-pressure refrigerant gas flows to a space above the electric motor by passing through an internal channel of the electric motor and is subsequently guided to an intake of the high-stage scroll compression mechanism, a substantial amount of the lubricating oil is separated from the refrigerant gas by, for example, colliding against various parts.

However, the intermediate-pressure refrigerant gas in the sealed housing is merged with a large amount of lubricating oil as mentioned above, and the lubricating oil is taken in by the high-stage scroll compression mechanism together with the refrigerant gas without being sufficiently separated therefrom. This lubricating oil is discharged from the high-stage scroll compression mechanism together with compressed refrigerant gas so as to circulate to the refrigeration cycle side.

As a result, an oil circulation ratio (OCR) [i.e., a ratio of the mass flow rate of lubricating oil to a total mass flow rate (refrigerant flow rate+lubricating-oil flow rate)] of lubricating oil circulating to the refrigeration cycle side increases. This leads to problems such as reduced system efficiency caused by inhibition of heat exchange at the refrigeration cycle side and a risk of shortage of lubricating oil in the compressor.

In view of the circumstances described above, an object of the present invention is to provide a multistage compressor that can reduce the oil circulation ratio by reducing the amount of lubricating oil to be taken in by the high-stage compression mechanism together with intermediate-pressure refrigerant gas discharged from the low-stage compression mechanism so as to improve the system efficiency and prevent a shortage of lubricating oil.

To achieve the aforementioned object, a multistage compressor of the present invention employs the following solutions.

Specifically, in a multistage compressor according to the present invention in which an electric motor is disposed in a substantially central section inside a sealed housing, a low-stage compression mechanism and a high-stage compression mechanism that are driven by the electric motor via a rotary shaft are disposed below and above to flank the electric motor, respectively, intermediate-pressure refrigerant gas compressed by the low-stage compression mechanism is discharged into the sealed housing, and the intermediate-pressure refrigerant gas is taken in by the high-stage compression mechanism so as to be compressed in two stages, an oil separator plate that centrifugally separates lubricating oil contained in the intermediate-pressure refrigerant gas, which is taken in by the high-stage compression mechanism after passing through the electric motor, is provided at one end of a rotor of the electric motor such that the rotary shaft extends through the oil separator plate.

According to the present invention, because the lubricating oil merged with the intermediate-pressure refrigerant gas, which is discharged from the low-stage compression mechanism so as to be taken in by the high-stage compression mechanism after passing through the electric motor, is centrifugally separated by the oil separator plate rotating together with the rotor and provided at one end of the rotor of the electric motor such that the rotary shaft extends through the oil separator plate, the amount of lubricating oil contained in the intermediate-pressure refrigerant gas is reduced before being taken in by the high-stage compression mechanism. Accordingly, the amount of lubricating oil to be taken in by the high-stage compression mechanism together with the intermediate-pressure refrigerant gas and to be discharged to the outside together with high-pressure compressed gas can be reduced. Consequently, an oil circulation ratio (OCR) [i.e., a ratio of the mass flow rate of lubricating oil to a total mass flow rate (refrigerant flow rate+lubricating-oil flow rate)] of lubricating oil circulating to the refrigeration cycle side can be reduced, thereby improving the system efficiency as well as preventing a shortage of lubricating oil in the compressor.

The multistage compressor of the present invention may be configured such that, in the aforementioned multistage compressor, a through-hole provided in the oil separator plate and through which the rotary shaft extends is provided such that an inner peripheral edge thereof is located closer towards a center than a gas channel hole provided in the rotor.

According to this configuration, since the inner peripheral edge of the through-hole provided in the oil separator plate and through which the rotary shaft extends is located closer towards the center than the gas channel hole provided in the rotor, the entire intermediate-pressure refrigerant gas containing the lubricating oil, after passing through the gas channel hole of the rotor, can be made to collide against the rotating oil separator plate, so that the lubricating oil contained in the intermediate-pressure refrigerant gas can be separated by the centrifugal separation effect of the oil separator plate. Consequently, the separation efficiency of the lubricating oil from the intermediate-pressure refrigerant gas is increased so that the oil circulation ratio can be reduced, thereby improving the system efficiency as well as preventing a shortage of lubricating oil.

The multistage compressor of the present invention may be configured such that, in the aforementioned multistage compressor, a sealing member forms a seal between an inner peripheral surface of the through-hole and an outer peripheral surface of the rotary shaft.

According to this configuration, the sealing member forming a seal between the through-hole in the oil separator plate and the rotary shaft prevents the intermediate-pressure refrigerant gas containing the lubricating oil from flowing downstream by passing through the gap in the through-hole, thereby increasing the separation efficiency of the lubricating oil by the oil separator plate. Thus, the oil circulation ratio can be further reduced, thereby improving the system efficiency as well as preventing a shortage of lubricating oil.

The multistage compressor of the present invention may be configured such that, in any one of the aforementioned multistage compressors, an inlet of a gas channel that guides the intermediate-pressure refrigerant gas, which passes through the electric motor and flows in between the electric motor and the high-stage compression mechanism, to an intake of the high-stage compression mechanism is provided at an inner peripheral side relative to a stator coil end of the electric motor.

According to this configuration, since the inlet of the gas channel that guides the intermediate-pressure refrigerant gas to the intake of the high-stage compression mechanism is provided at the inner peripheral side relative to the stator coil end of the electric motor, the lubricating oil centrifugally separated by the oil separator plate can be made to flow toward the outer periphery of the stator coil end, whereas the intermediate-pressure refrigerant gas can be guided from the inner peripheral region, which is where the amount of lubricating oil is reduced, of the stator coil end to the intake of the high-stage compression mechanism through the gas channel. Thus, the amount of lubricating oil contained in the intermediate-pressure refrigerant gas and to be taken in by the high-stage compression mechanism can be further reduced. Accordingly, the oil circulation ratio (OC %) of lubricating oil circulating to the refrigeration cycle side can be reduced, thereby improving the system efficiency as well as preventing a shortage of lubricating oil in the compressor.

The multistage compressor of the present invention may be configured such that, in the aforementioned multistage compressor, a section of the gas channel is formed between an outer peripheral surface of a supporting member of the high-stage compression mechanism and an inner peripheral surface of the sealed housing.

According to this configuration, since the section of the gas channel that guides the intermediate-pressure refrigerant gas to the high-stage compression mechanism is formed between the outer peripheral surface of the supporting member of the high-stage compression mechanism and the inner peripheral surface of the sealed housing, the section of the gas channel can be formed readily by, for example, integrally forming the section on the outer peripheral surface of the supporting member by die casting during a molding process. Thus, the number of processes to be performed when forming the gas channel can be reduced, thereby minimizing the cost of manufacturing.

The multistage compressor of the present invention may be configured such that, in the aforementioned multistage compressor, the section of the gas channel formed between the outer peripheral surface of the supporting member and the inner peripheral surface of the sealed housing is sealed from a gap below the section by means of a sealing member.

According to this configuration, since the section of the gas channel is sealed from the gap therebelow by means of the sealing member, the intermediate-pressure refrigerant gas containing a large amount of lubricating oil can be prevented from flowing into the gas channel through the gap between the outer peripheral surface of the supporting member and the inner peripheral surface of the sealed housing, thereby reducing the amount of lubricating oil contained in the intermediate-pressure refrigerant gas and to be taken in by the high-stage compression mechanism. Consequently, the oil circulation ratio can be reduced, thereby improving the system efficiency as well as preventing a shortage of lubricating oil.

The multistage compressor of the present invention may be configured such that, in the aforementioned multistage compressor, a section of the gas channel is formed between a lower surface of a supporting member of the high-stage compression mechanism and an upper surface of a bracket that fixes the supporting member within the sealed housing.

According to this configuration, since the section of the gas channel that guides the intermediate-pressure refrigerant gas to the high-stage compression mechanism is formed between the lower surface of the supporting member of the high-stage compression mechanism and the upper surface of the bracket that fixes the supporting member within the sealed housing, the formation of the gas channel can be simplified. Thus, the number of processes to be performed when forming the gas channel can be reduced, thereby minimizing the cost of manufacturing.

The multistage compressor of the present invention may be configured such that, in the aforementioned multistage compressor, an inner peripheral edge of the bracket extends toward the inner peripheral side beyond the stator coil end of the electric motor.

According to this configuration, since the inner peripheral edge of the bracket extends toward the inner peripheral side beyond the stator coil end of the electric motor, the inlet of the gas channel formed between the lower surface of the supporting member and the upper surface of the bracket can be opened to the inner peripheral region, which is where the amount of lubricating oil is reduced, of the stator coil end, so that the intermediate-pressure refrigerant gas can be guided to the intake of the high-stage compression mechanism. Thus, the amount of lubricating oil contained in the intermediate-pressure refrigerant gas and to be taken in by the high-stage compression mechanism can be reduced, thereby reducing the oil circulation ratio.

The multistage compressor of the present invention may be configured such that, in any one of the aforementioned multistage compressors, an outer-peripheral lower surface of the bracket has a downward slope.

According to this configuration, since the outer-peripheral lower surface of the bracket that fixes the supporting member of the high-stage compression mechanism in place has the downward slope, a baffle effect of this slope can facilitate the separation of the lubricating oil from the intermediate-pressure refrigerant gas. Thus, the amount of lubricating oil contained in the intermediate-pressure refrigerant gas and to be taken in by the high-stage compression mechanism can be reduced. In addition, the bracket can be increased in strength so that the high-stage compression mechanism can be securely fixed within the sealed housing.

The multistage compressor of the present invention may be configured such that, in the aforementioned multistage compressor, the bracket is provided with a plate whose inner peripheral edge extends toward the inner peripheral side beyond the stator coil end of the electric motor.

According to this configuration, since the inner peripheral edge of the plate provided on the bracket extends toward the inner peripheral side beyond the stator coil end of the electric motor, the inlet of the gas channel formed between the lower surface of the supporting member and the upper surface of the bracket can be opened to the inner peripheral region, which is where the amount of lubricating oil is reduced, of the stator coil end, so that the intermediate-pressure refrigerant gas can be guided to the intake of the high-stage compression mechanism. Thus, the amount of lubricating oil contained in the intermediate-pressure refrigerant gas and to be taken in by the high-stage compression mechanism can be reduced, thereby reducing the oil circulation ratio.

The multistage compressor of the present invention may be configured such that, in the aforementioned multistage compressor, an outer peripheral edge of the plate is bent downward to form a slope.

According to this configuration, since the outer peripheral edge of the plate provided on the bracket is bent downward to form a slope, a baffle effect of this slope can facilitate the separation of the lubricating oil from the intermediate-pressure refrigerant gas. Thus, the amount of lubricating oil contained in the intermediate-pressure refrigerant gas and to be taken in by the high-stage compression mechanism can be reduced, thereby reducing the oil circulation ratio.

The multistage compressor of the present invention may be configured such that, in any one of the aforementioned multistage compressors, a gas channel that guides the intermediate-pressure refrigerant gas, which passes through the electric motor and flows in between the electric motor and the high-stage compression mechanism, to an intake of the high-stage compression mechanism is formed between an outer peripheral surface of a supporting member of the high-stage compression mechanism and an inner peripheral surface of the sealed housing, and a downwardly-bent baffle plate is provided near an inlet of the gas channel.

According to this configuration, since the gas channel that guides the intermediate-pressure refrigerant gas to the intake of the high-stage compression mechanism is formed between the outer peripheral surface of the supporting member and the inner peripheral surface of the sealed housing, and the downwardly-bent baffle plate is provided near the inlet thereof, the flow of intermediate-pressure refrigerant gas directed towards the gas channel formed at the outer peripheral side can be redirected downward by the downwardly-bent baffle plate. In this case, the lubricating oil contained in the intermediate-pressure refrigerant gas keeps flowing downward due to inertia, so as to become separated from the intermediate-pressure refrigerant gas. Thus, the amount of lubricating oil contained in the intermediate-pressure refrigerant gas can be reduced, and the intermediate-pressure refrigerant gas can be guided to the intake of the high-stage compression mechanism through the gas channel. Accordingly, the oil circulation ratio (OCR) of lubricating oil circulating to the refrigeration cycle side can be reduced, thereby improving the system efficiency as well as preventing a shortage of lubricating oil in the compressor.

According to the present invention, since the amount of lubricating oil to be taken in by the high-stage compression mechanism together with the intermediate-pressure refrigerant gas and to be discharged to the outside together with high-pressure compressed gas can be reduced, the oil circulation ratio (OCR) of lubricating oil circulating to the refrigeration cycle side can be reduced, thereby improving the system efficiency as well as preventing a shortage of lubricating oil in the compressor.

EXPLANATION OF REFERENCE SIGNS

Figure 1:
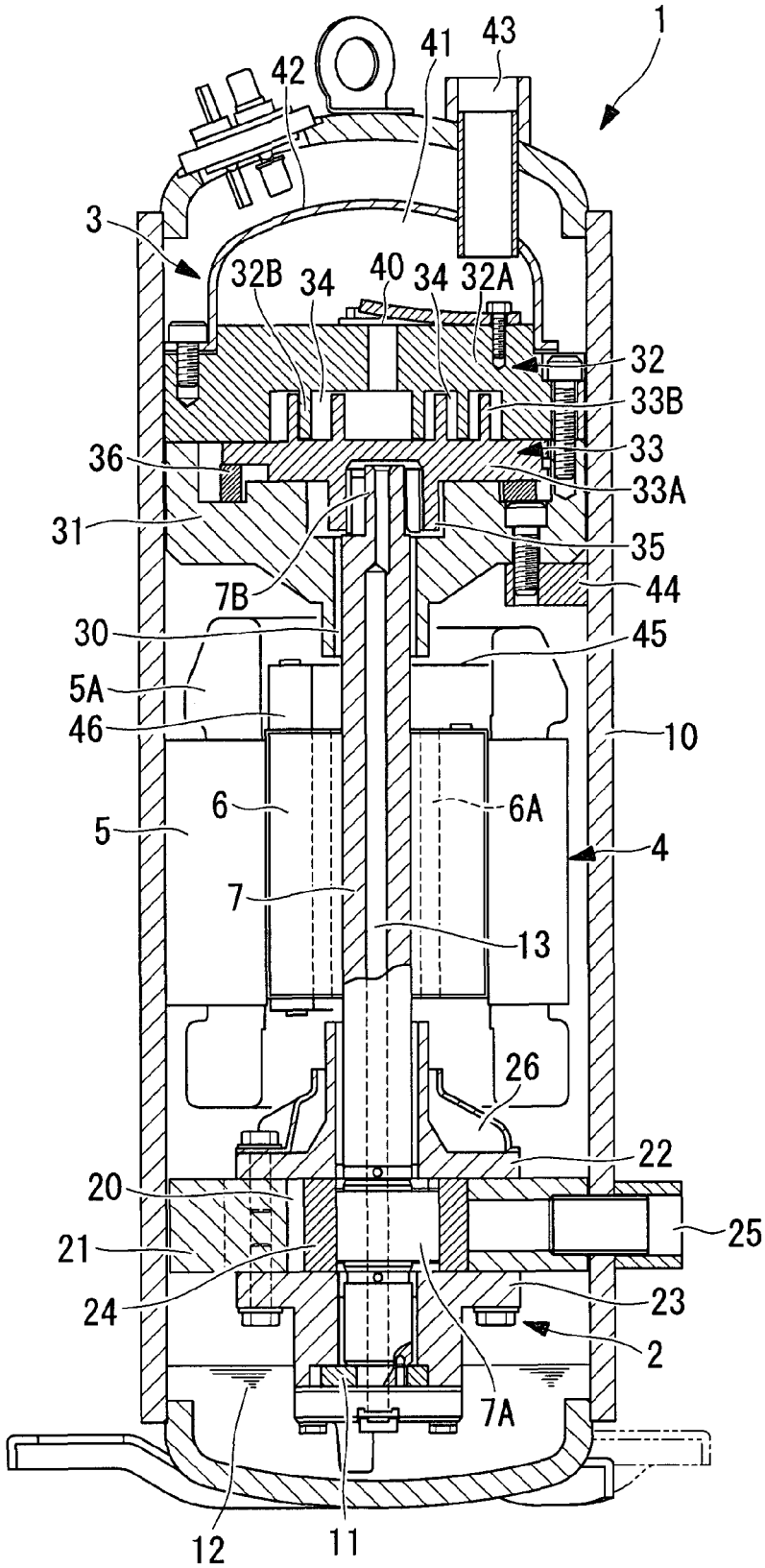
FIG. 1 is a longitudinal sectional view of a multistage compressor according to a first embodiment of the present invention.

1: multistage compressor
2: low-stage compression mechanism (low-stage rotary compression mechanism)
3: high-stage compression mechanism (high-stage scroll compression mechanism)
4: electric motor
5A: stator coil end
6: rotor
6A: gas channel hole
7: rotary shaft
10: sealed housing
10A: inner peripheral surface of sealed housing
31: supporting member
31A: lower surface of supporting member
31B: outer peripheral surface of supporting member
44: bracket
44A: upper surface of bracket
44B: slope of bracket
45, 50: oil separator plate
47, 51: through-hole
52: sealing member
55: intake of high-stage scroll compression mechanism
56: gas channel

57: inlet of gas channel
58, 60: section of gas channel
59: sealing member
61: plate
61A: slope of plate
66: gas channel
67: inlet of gas channel
68: baffle plate

BEST MODE FOR CARRYING OUT THE INVENTION

Embodiments according to the present invention will be described below with reference to the drawings.

[First Embodiment]

A first embodiment of the present invention will be described below with reference to FIG. 1 and FIG. 2.

FIG. 1 is a longitudinal sectional view of a multistage compressor 1 for refrigerating/air-conditioning, which includes a low-stage compression mechanism 2 and a high-stage compression mechanism 3. Although the multistage compressor 1 described as an example in this embodiment employs a rotary compression mechanism as the low-stage compression mechanism 2 and a scroll compression mechanism as the high-stage compression mechanism 3 for the sake of convenience, it is to be noted that the low-stage compression mechanism 2 and the high-stage compression mechanism 3 are not limited to the aforementioned compression mechanisms.

The multistage compressor 1 includes a sealed housing 10. An electric motor 4 formed of a stator 5 and a rotor 6 is fixed to a substantially central section inside the sealed housing 10. A rotary shaft (crankshaft) 7 is integrally joined to the rotor 6. The low-stage rotary compression mechanism 2 is disposed below the electric motor 4. The low-stage rotary compression mechanism 2 is formed of a known type of rotary compression mechanism that includes a cylinder body 21 having a cylinder chamber 20 and fixed to the sealed housing 10, an upper bearing 22 and a lower bearing 23 respectively fixed above and below the cylinder body 21 to seal upper and lower sections of the cylinder chamber 20, a rotor 24 fitted to a crank portion 7A of the rotary shaft 7 and rotating within an inner peripheral surface of the cylinder chamber 20, and a blade retaining spring and a blade (not shown) that partition the cylinder chamber 20 into an intake side and a discharge side.

This low-stage rotary compression mechanism 2 is configured to take low-pressure refrigerant gas (working gas) into the cylinder chamber 20 through an intake pipe 25, compress this refrigerant gas to intermediate pressure by rotating the rotor 24, and then discharge the refrigerant gas into the sealed housing 10 through a discharge chamber 26. This intermediate-pressure refrigerant gas flows to a space above the electric motor 4 by passing through, for example, a gas channel hole 6A provided in the rotor 6 of the electric motor 4, and is then taken in by the high-stage scroll compression mechanism 3 so as to be compressed in two stages.

The high-stage scroll compression mechanism 3 is formed of a known type of scroll compression mechanism that includes a supporting member 31 (also called a frame member or a bearing member) fixed to the sealed housing 10 and provided with a bearing 30 that supports the rotary shaft (crankshaft) 7, a fixed scroll member 32 and an orbiting scroll member 33 that have spiral wraps 32B and 33B protruding from end plates 32A and 33A, respectively, and that form a pair of compression chambers 34 by engaging the spiral wraps 32B and 33B to each other when mounted on the supporting member 31, an orbiting boss 35 that joins the orbiting scroll member 33 to an eccentric pin 7B provided at a shaft end of the rotary shaft 7 so as to cause the orbiting scroll member 33 to revolve in an orbit, a self-rotation preventing mechanism 36, such as an Oldham ring, which is provided between the orbiting scroll member 33 and the supporting member 31 and allows the orbiting scroll member 33 to revolve in an orbit while preventing it from self-rotating, a discharge valve 40 provided at the back face of the fixed scroll member 32, and a discharge cover 42 that is fixed to the back face of the fixed scroll member 32 and that forms a discharge chamber 41 between the discharge cover 42 and the fixed scroll member 32.

The aforementioned high-stage scroll compression mechanism 3 is configured to take the intermediate-pressure refrigerant gas discharged to the sealed housing 10 after being compressed by the low-stage rotary compression mechanism 2 into the compression chambers 34, compress this intermediate-pressure refrigerant gas until it reaches a high-temperature high-pressure state by revolving the orbiting scroll member 33 in an orbit, and then discharge the refrigerant gas into the discharge chamber 41 through the discharge valve 40. This high-temperature high-pressure refrigerant gas is guided from the discharge chamber 41 to the outside of the compressor, i.e., a refrigeration cycle side, through a discharge pipe 43. The supporting member 31 constituting the high-stage scroll compression mechanism 3 is fixed with a screw to a bracket 44 provided in the sealed housing 10.

A known positive-displacement oil pump 11 is fitted between the lowermost end of the rotary shaft (crankshaft) 7 and the lower bearing 23 of the low-stage rotary compression mechanism 2. This oil pump 11 is configured to pump up lubricating oil 12, which fills the bottom of the sealed housing 10, so as to forcedly supply the lubricating oil 12 to desired sections to be lubricated, such as the bearings in the low-stage rotary compression mechanism 2 and the high-stage scroll compression mechanism 3, through an oil hole 13 provided in the rotary shaft 7.

Figure 2:
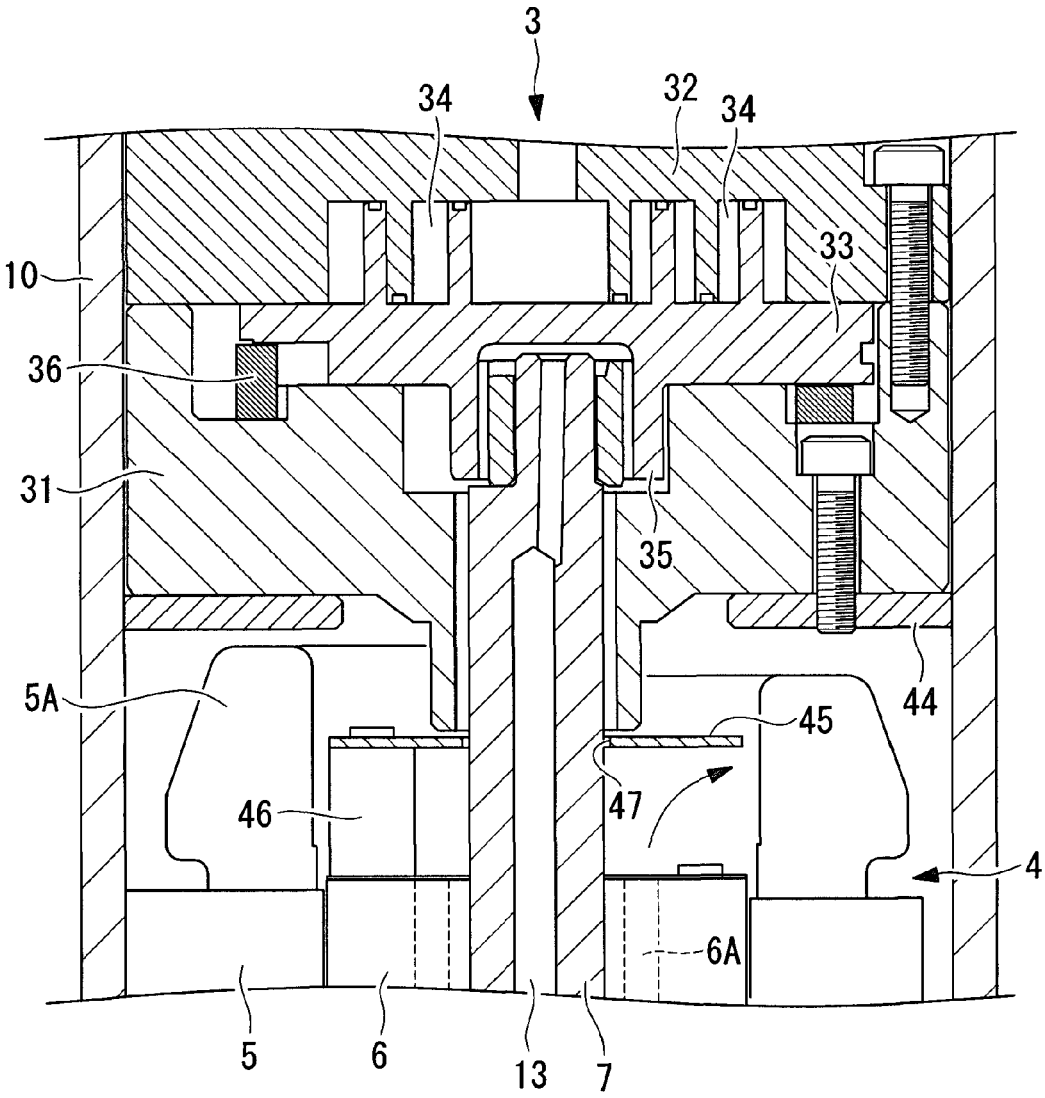
FIG. 2 is an enlarged longitudinal sectional view showing a relevant part of the multistage compressor shown in FIG. 1.

Furthermore, as shown in FIG. 2, an upper end of the rotor 6 constituting the electric motor 4 is provided with an oil separator plate 45 that is rotated integrally with the rotor 6. This oil separator plate 45 is formed of a disk that is mounted on a balance weight 46 (mounted by means of a spacer if there is no balance weight) provided at the upper end of the rotor 6; the disk has an outside diameter that ensures a slight gap against the inner periphery of a stator coil end 5A of the electric motor 4. A central section of the oil separator plate 45 is provided with a through-hole 47 through which the rotary shaft 7 extends. This through-hole 47 has a size such that the inner peripheral edge thereof is located closer towards the center than the gas channel hole 6A provided in the rotor 6 and such that a gap formed between the inner peripheral edge and the outer peripheral surface of the rotary shaft 7 is made as small as possible.

With the above-described configuration, this embodiment provides the following advantages.

Low-temperature low-pressure refrigerant gas taken into the cylinder chamber 20 of the low-stage rotary compression mechanism 2 through the intake pipe 25 is compressed to intermediate pressure by the rotation of the rotor 24 and is subsequently discharged to the discharge chamber 26. This intermediate-pressure refrigerant gas is discharged from the discharge chamber 26 to a space below the electric motor 4 and then flows to the space above the electric motor 4 by passing through, for example, the gas channel hole 6A provided in the rotor 6 of the electric motor 4.

The intermediate-pressure refrigerant gas flowing into the space above the electric motor 4 travels through, for example, a gap between the supporting member 31 constituting the high-stage scroll compression mechanism 3 and the sealed housing 10, and is guided to an intake, provided in the fixed scroll member 32, of the high-stage scroll compression mechanism 3 so as to be taken into the compression chambers 34. After being compressed in two stages by the high-stage scroll compression mechanism 3 to reach a high-temperature high-pressure state, the intermediate-pressure refrigerant gas is discharged from the discharge valve 40 to the discharge chamber 41 so as to be guided to the outside, i.e., the refrigeration cycle side, of the compressor through the discharge pipe 43.

In the two-stage compressing process mentioned above, a portion of the lubricating oil 12 used for lubricating the low-stage rotary compression mechanism 2 is merged with the refrigerant gas and is discharged into the sealed housing 10 together with the intermediate-pressure refrigerant gas. Furthermore, after the lubricating oil 12 is supplied to the high-stage scroll compression mechanism 3 through the oil hole 13 to lubricate the high-stage scroll compression mechanism 3, a portion of the lubricating oil 12 flowing down to the bottom of the sealed housing 10 merges with the intermediate-pressure refrigerant gas. When flowing to the space above the electric motor 4 by passing through the gas channel hole 6A in the rotor 6, the intermediate-pressure refrigerant gas merged with the lubricating oil 12 collides against the oil separator plate 45 rotating together with the rotor 6; hence, a centrifugal separation effect of the oil separator plate 45 causes the lubricating oil 12 to become separated from the intermediate-pressure refrigerant gas.

The centrifugally separated lubricating oil 12 travels through a gap in the stator coil end 5A of the electric motor 4 so as to be guided towards the outer periphery of the stator coil end 5A. The lubricating oil 12 then flows down to the bottom of the sealed housing 10 along the inner peripheral surface thereof. On the other hand, the intermediate-pressure refrigerant gas separated from the lubricating oil 12 flows into the space above the electric motor 4 through the gap around the outer periphery of the oil separator plate 45, is guided from the space above the electric motor 4 to the intake of the high-stage scroll compression mechanism 3, and is taken into the compression chambers 34 so as to be compressed in two stages.

Since the intermediate-pressure refrigerant gas separated from the lubricating oil 12 can be taken in by the high-stage scroll compression mechanism 3 in this manner, the amount of lubricating oil 12 to be taken in by the high-stage scroll compression mechanism 3 together with the intermediate-pressure refrigerant gas and to be discharged to the outside together with high-pressure compressed gas can be reduced. Consequently, an oil circulation ratio (OCR) [i.e., a ratio of the mass flow rate of lubricating oil to a total mass flow rate (refrigerant flow rate+lubricating-oil flow rate)] of the lubricating oil 12 circulating to the refrigeration cycle side can be reduced, thereby improving the system efficiency as well as preventing a shortage of lubricating oil in the compressor.

Furthermore, the oil separator plate 45 is provided with the through-hole 47 through which the rotary shaft 7 extends, and this through-hole 47 is provided such that the inner peripheral edge thereof is located closer towards the center than the gas channel hole 6A provided in the rotor 6 and such that the gap formed between the inner peripheral edge and the rotary shaft 7 is made as small as possible. Therefore, after passing through the gas channel hole 6A in the rotor 6, the intermediate-pressure refrigerant gas containing the lubricating oil 12 always collides against the oil separator plate 45, whereby the lubricating oil 12 contained in the intermediate-pressure refrigerant gas can be separated by the centrifugal separation effect of the oil separator plate 45. Accordingly, the separation efficiency of the lubricating oil 12 from the intermediate-pressure refrigerant gas is increased so that the oil circulation ratio can be further reduced, thereby improving the system efficiency as well as preventing a shortage of lubricating oil.

[Second Embodiment]

Figure 3:
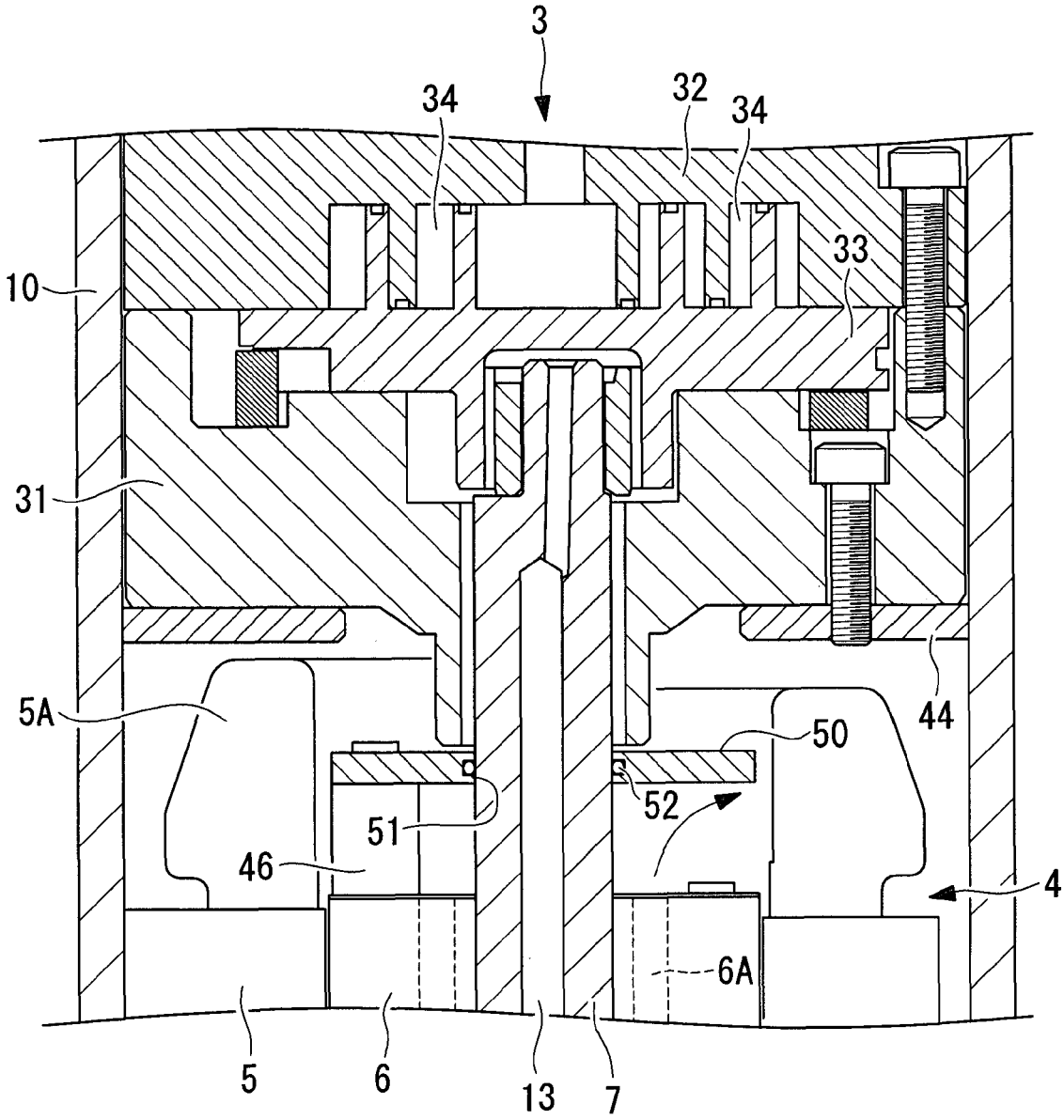
FIG. 3 is an enlarged longitudinal sectional view showing a relevant part of a multistage compressor according to a second embodiment of the present invention.

A second embodiment of the present invention will now be described with reference to FIG. 3.

This embodiment differs from the first embodiment in the configuration of an oil separator plate 50. Other points are similar to those in the first embodiment, and therefore, the descriptions thereof will be omitted.

The oil separator plate 50 in this embodiment has a thickness greater than that of the oil separator plate 45 in the first embodiment. An inner peripheral surface of a through-hole 51, through which the rotary shaft 7 extends, provided at the central section of the oil separator plate 50 is provided with a sealing member 52, such as an O-ring, for sealing the gap between the inner peripheral surface of the through-hole 51 and the outer peripheral surface of the rotary shaft 7.

As described above, the sealing member 52 seals the gap between the through-hole 51 provided in the oil separator plate 50 and the rotary shaft 7 so as to prevent the intermediate-pressure refrigerant gas containing the lubricating oil 12 from flowing downstream by passing through the gap in the through-hole 51, thereby increasing the separation efficiency of the lubricating oil 12 by the oil separator plate 50. Thus, the amount of lubricating oil 12 contained in the intermediate-pressure refrigerant gas and to be taken in by the high-stage scroll compression mechanism 3 can be further reduced. Consequently, the oil circulation ratio can be further reduced, thereby improving the system efficiency as well as preventing a shortage of lubricating oil.

[Third Embodiment]

Figure 4:
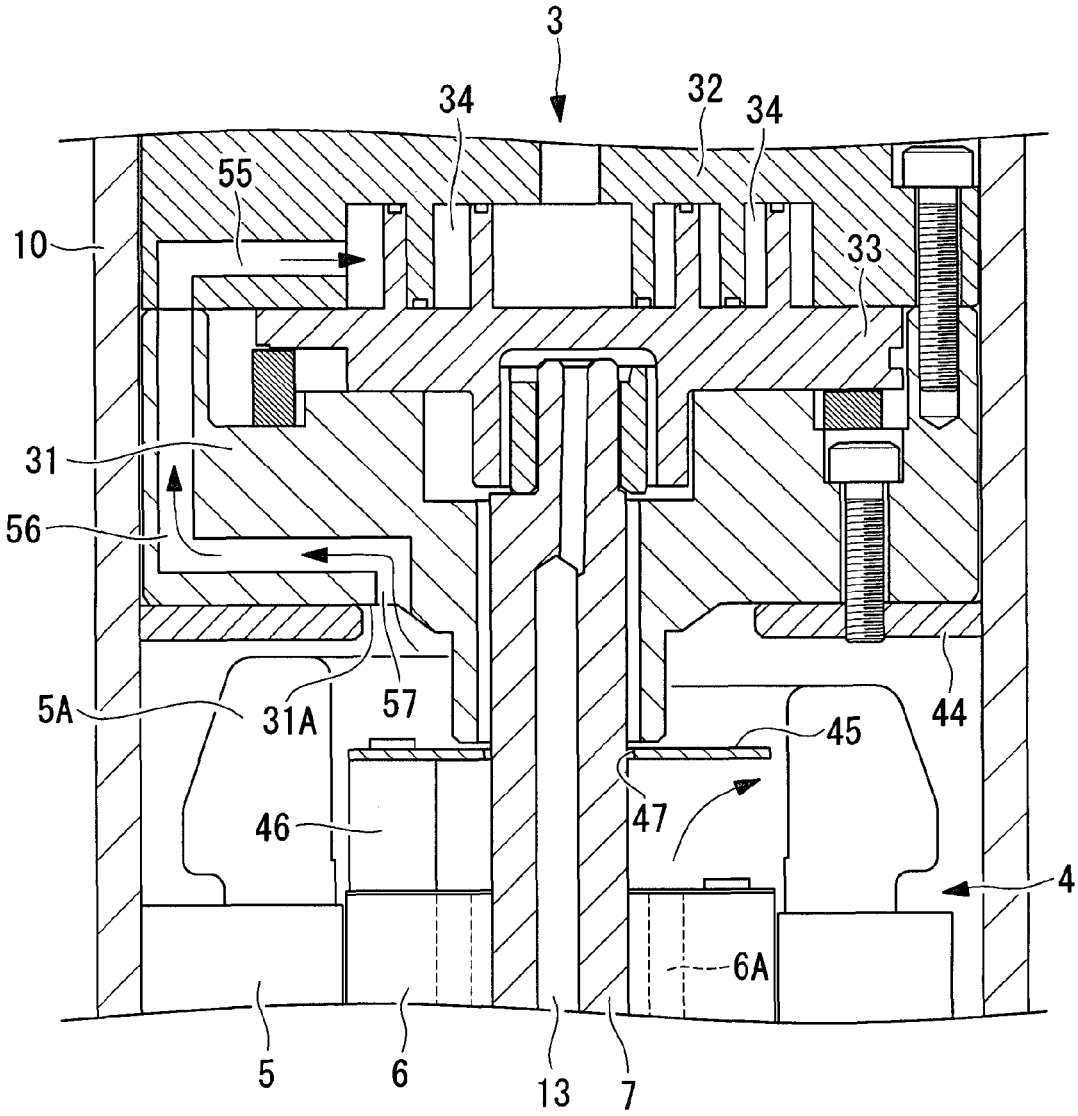
FIG. 4 is an enlarged longitudinal sectional view showing a relevant part of a multistage compressor according to a third embodiment of the present invention.

A third embodiment of the present invention will now be described with reference to FIG. 4.

This embodiment differs from the first embodiment in the configuration of a gas channel 56 that guides the intermediate-pressure refrigerant gas from the space above the electric motor 4 to an intake 55 of the high-stage scroll compression mechanism 3. Other points are similar to those in the first embodiment, and therefore, the descriptions thereof will be omitted.

In this embodiment, the gas channel 56 that guides the intermediate-pressure refrigerant gas to the intake 55 of the high-stage scroll compression mechanism 3 extends within the supporting member 31, and an inlet 57 thereof is provided on a lower surface 31A of the supporting member 31 at an inner peripheral side relative to the stator coil end 5A of the electric motor 4.

As described above, because the gas channel 56 that guides the intermediate-pressure refrigerant gas to the intake 55 of the high-stage scroll compression mechanism 3 is provided within the supporting member 31, and the inlet 57 thereof is provided on the inner peripheral side relative to the stator coil end 5A of the electric motor 4, the lubricating oil 12 centrifugally separated by the oil separator plate 45 can be made to flow toward the outer periphery of the stator coil end 5A, whereas the intermediate-pressure refrigerant gas can be guided from the inner peripheral region, which is where the amount of lubricating oil 12 is reduced, of the stator coil end 5A to the intake 55 of the high-stage scroll compression mechanism 3 through the gas channel 56. Thus, the amount of lubricating oil 12 contained in the intermediate-pressure refrigerant gas and to be taken in by the high-stage scroll compression mechanism 3 can be minimized. Accordingly, the oil circulation ratio (OCR) of lubricating oil circulating to the refrigeration cycle side can be reduced, thereby improving the system efficiency as well as preventing a shortage of lubricating oil in the compressor.

[Fourth Embodiment]

Figure 5:
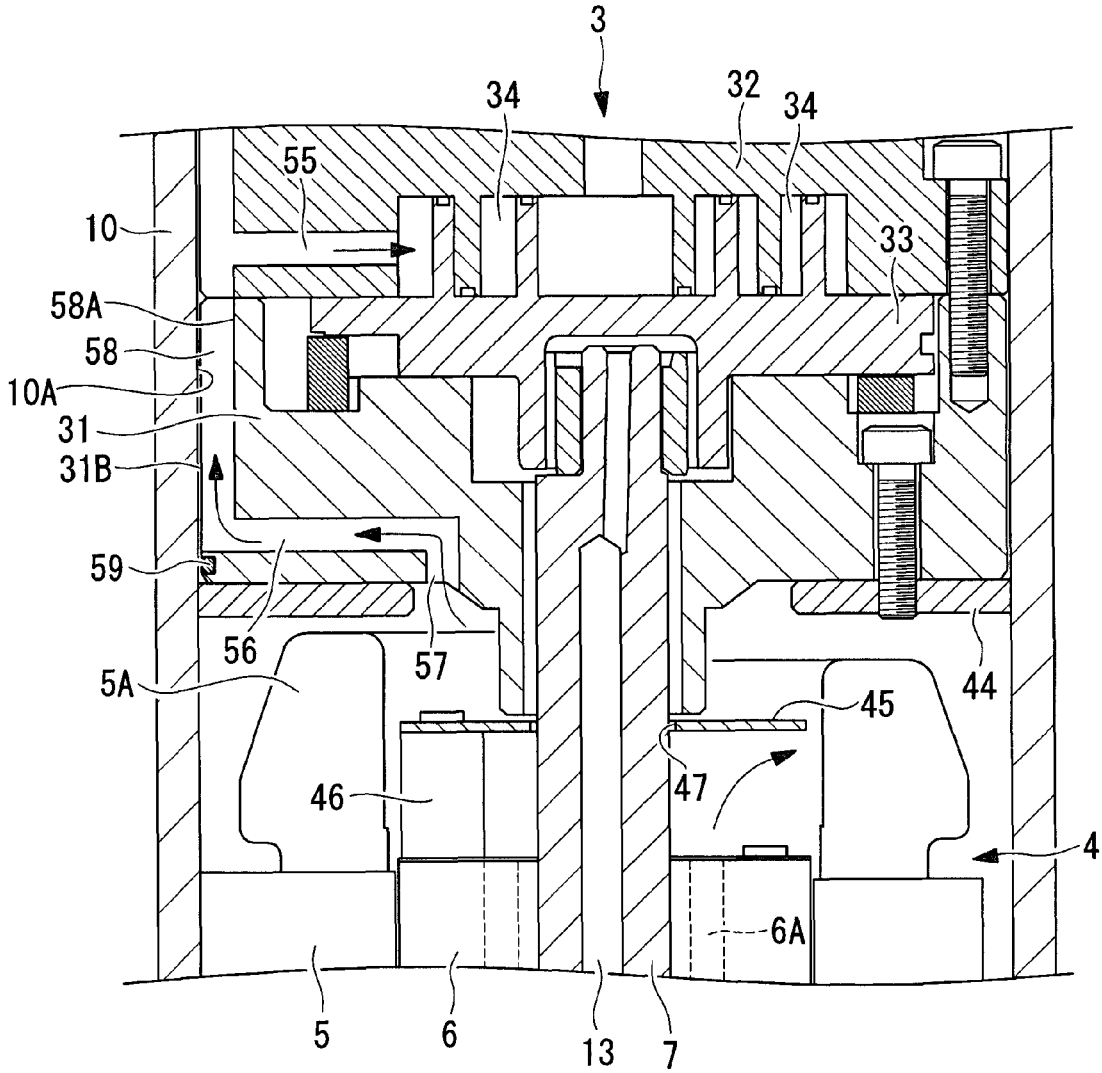
FIG. 5 is an enlarged longitudinal sectional view showing a relevant part of a multistage compressor according to a fourth embodiment of the present invention.

A fourth embodiment of the present invention will now be described with reference to FIG. 5.

This embodiment differs from the first and third embodiments partly in the configuration of the gas channel 56 that guides the intermediate-pressure refrigerant gas to the intake 55 of the high-stage scroll compression mechanism 3. Other points are similar to those in the first and third embodiments, and therefore, the descriptions thereof will be omitted.

In this embodiment, a section 58 of the gas channel 56 is formed between an outer peripheral surface 31B of the supporting member 31 and an inner peripheral surface 10A of the sealed housing 10. Specifically, a groove 58A is integrally formed on the outer peripheral surface 31B of the supporting member 31 by die casting during a molding process, and the section 58 of the gas channel 56 is formed by this groove 58A and the inner peripheral surface 10A of the sealed housing 10. In order to seal the section 58 of the gas channel 56 from a gap therebelow formed between the inner peripheral surface 10A of the sealed housing 10 and the outer peripheral surface 31B of the supporting member 31, a sealing member 59, such as an O-ring, is provided below the gas channel 56.

As described above, the groove 58A is formed on the outer peripheral surface 31B of the supporting member 31 by die casting during a molding process so as to form the section 58 of the gas channel 56 by this groove 58A and the inner peripheral surface 10A of the sealed housing 10, thereby facilitating the formation of the gas channel 56. Thus, the number of processes, such as for forming holes, to be performed when forming the gas channel 56 can be reduced, thereby minimizing the cost of manufacturing. Moreover, since the section 58 of the gas channel 56 is sealed from the gap therebelow by means of the sealing member 59, the intermediate-pressure refrigerant gas containing the lubricating oil 12 is prevented from flowing into the gas channel 56 through the gap between the supporting member 31 and the sealed housing 10, thereby minimizing the amount of lubricating oil 12 contained in the intermediate-pressure refrigerant gas and to be taken in by the high-stage scroll compression mechanism 3. Consequently, the oil circulation ratio can be reduced, thereby improving the system efficiency as well as preventing a shortage of lubricating oil.

[Fifth Embodiment]

Figure 6:
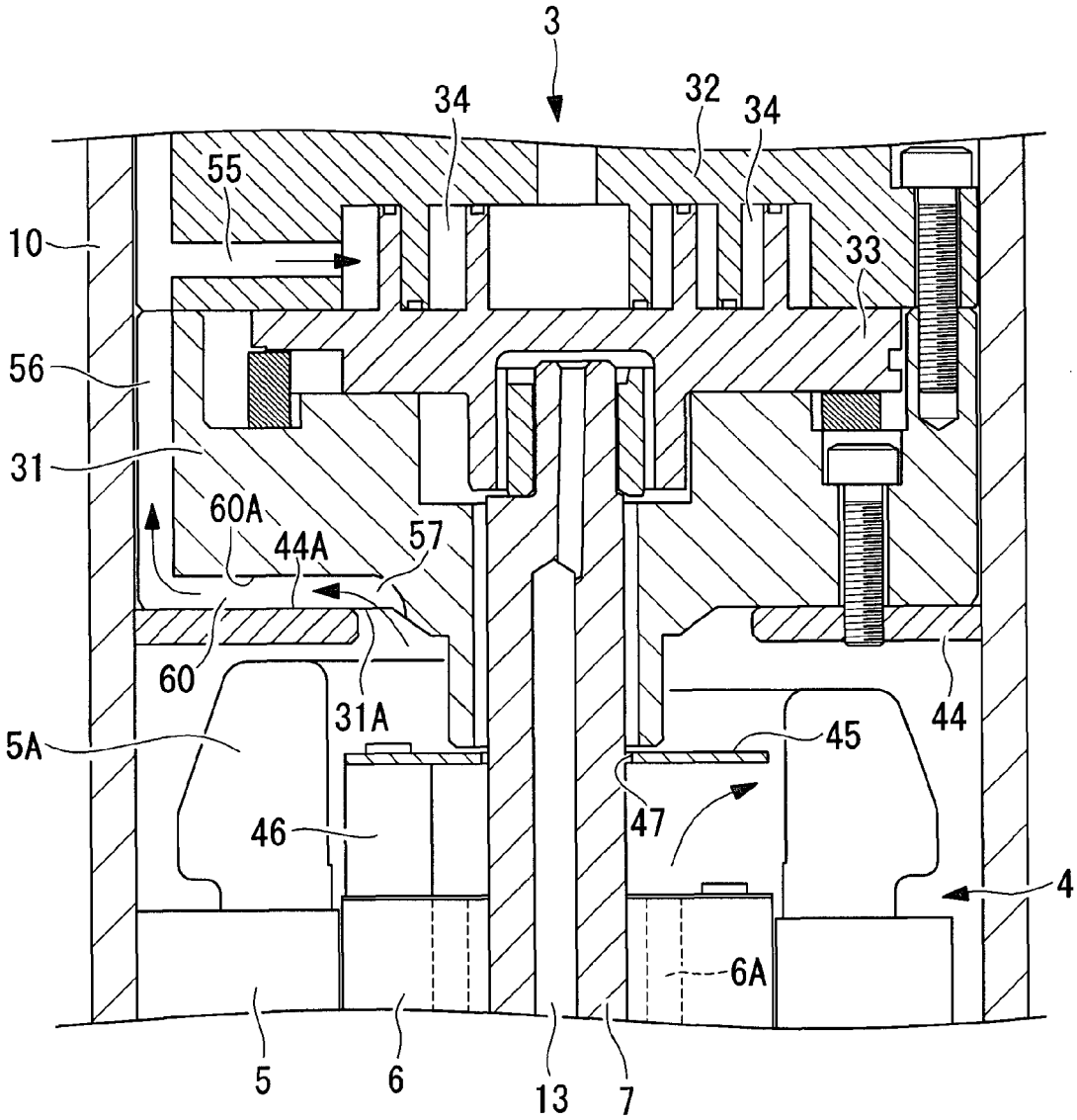
FIG. 6 is an enlarged longitudinal sectional view showing a relevant part of a multistage compressor according to a fifth embodiment of the present invention.

A fifth embodiment of the present invention will now be described with reference to FIG. 6.

This embodiment differs from the first, third, and fourth embodiments partly in the configuration of the gas channel 56 that guides the intermediate-pressure refrigerant gas to the intake 55 of the high-stage scroll compression mechanism 3. Other points are similar to those in the first, third, and fourth embodiments, and therefore, the descriptions thereof will be omitted.

In this embodiment, a section 60 of the gas channel 56 is formed between the lower surface 31A of the supporting member 31 and an upper surface 44A of the bracket 44. Specifically, a groove 60A is integrally formed on the lower surface 31A of the supporting member 31 by die casting during a molding process, and the section 60 of the gas channel 56 is defined by this groove 60A and the upper surface 44A of the bracket 44.

As described above, the groove 60A is integrally formed on the lower surface 31A of the supporting member 31 by die casting during a molding process so that the section 60 of the gas channel 56 is formed by this groove 60A and the upper surface 44A of the bracket 44, thereby facilitating the formation of the gas channel 56. Thus, the number of processes, such as for forming holes, to be performed when forming the gas channel 56 can be reduced, thereby minimizing the cost of manufacturing.

[Sixth Embodiment]

Figure 7:
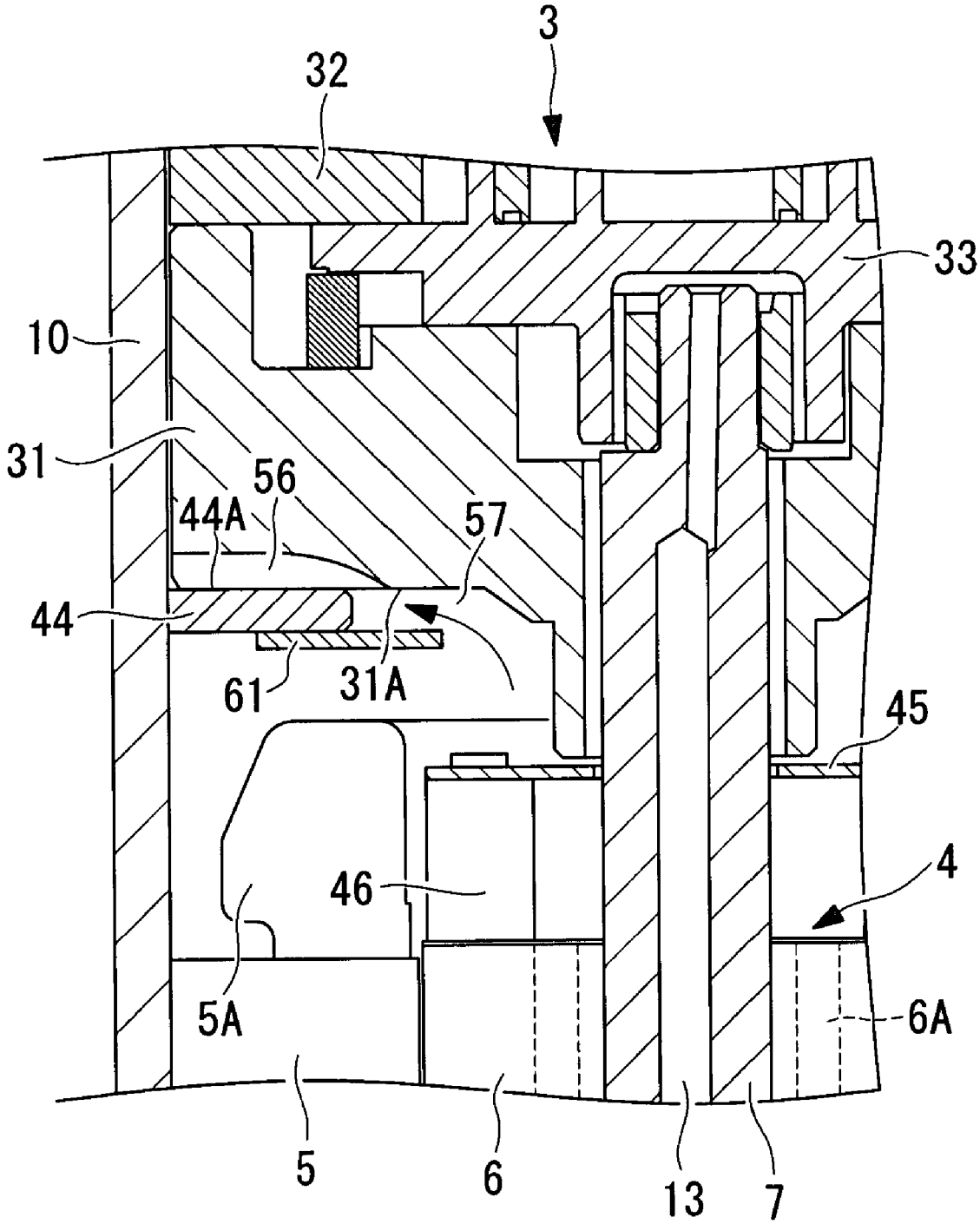
FIG. 7 is an enlarged longitudinal sectional view showing a relevant part of a multistage compressor according to a sixth embodiment of the present invention.

A sixth embodiment of the present invention will now be described with reference to FIG. 7.

This embodiment differs from the first embodiment and the third to fifth embodiments partly in the configuration of the gas channel 56 that guides the intermediate-pressure refrigerant gas to the intake 55 of the high-stage scroll compression mechanism 3. Other points are similar to those in the first embodiment and the third to fifth embodiments, and therefore, the descriptions thereof will be omitted.

In this embodiment, a lower surface of the bracket 44 is provided with a plate 61 whose inner peripheral edge extends toward the inner peripheral side beyond the stator coil end 5A of the electric motor 4 so that the inlet 57 of the gas channel 56 can be provided on the inner peripheral side relative to the stator coil end 5A of the electric motor 4.

As described above, the inner peripheral edge of the plate 61 provided on the bracket 44 extends toward the inner peripheral side beyond the stator coil end 5A of the electric motor 4 so that the inlet 57 of the gas channel 56 formed between the lower surface 31A of the supporting member 31 and the upper surface 44A of the bracket 44 can be opened to the inner peripheral region, which is where the amount of lubricating oil 12 is reduced, of the stator coil end 5A, and the intermediate-pressure refrigerant gas can be guided to the intake of the high-stage scroll compression mechanism 3. Thus, the amount of lubricating oil 12 contained in the intermediate-pressure refrigerant gas and to be taken in by the high-stage scroll compression mechanism 3 can be reduced, thereby reducing the oil circulation ratio. This embodiment is advantageous in the case where the bracket 44 projects by a small amount in the radial direction.

[Seventh Embodiment]

Figure 8:
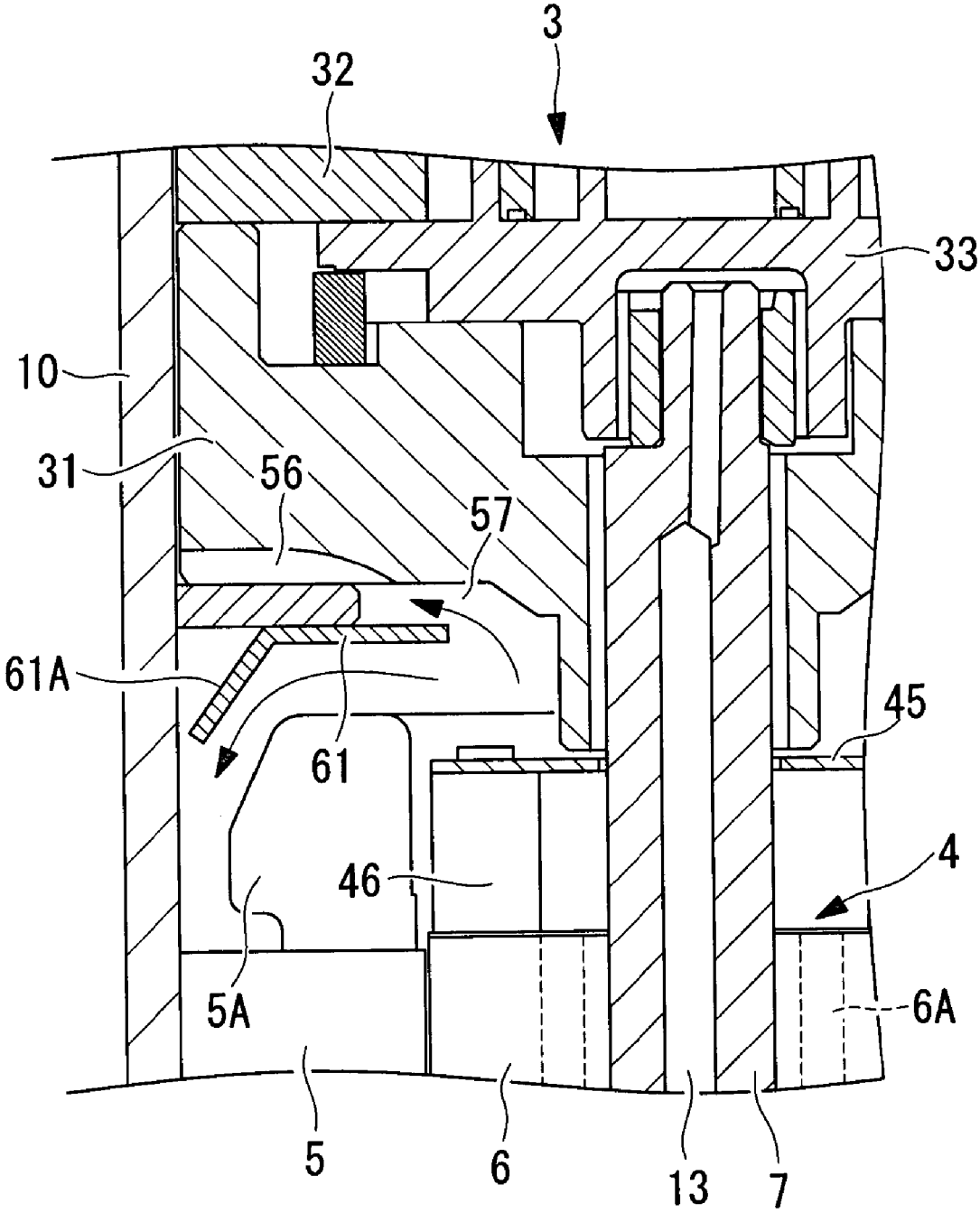
FIG. 8 is an enlarged longitudinal sectional view showing a relevant part of a multistage compressor according to a seventh embodiment of the present invention.

A seventh embodiment of the present invention will now be described with reference to FIG. 8.

This embodiment differs from the sixth embodiment partly in the configuration of the plate 61. Other points are similar to those in the first embodiment and the third to sixth embodiments, and therefore, the descriptions thereof will be omitted.

In this embodiment, an outer peripheral edge of the plate 61 in the sixth embodiment described above is bent downward to form a slope 61A.

As described above, because the outer peripheral edge of the plate 61 provided on the bracket 44 is bent downward to form the slope 61A, the slope 61A exhibits a baffle effect against the intermediate-pressure refrigerant gas containing the lubricating oil 12 flowing along an arrow shown in the drawing in the space above the electric motor 4, thereby facilitating the separation of the lubricating oil 12 from the intermediate-pressure refrigerant gas. Thus, the amount of lubricating oil 12 contained in the intermediate-pressure refrigerant gas and to be taken in by the high-stage scroll compression mechanism 3 can be reduced, thereby reducing the oil circulation ratio.

[Eighth Embodiment]

Figure 9:
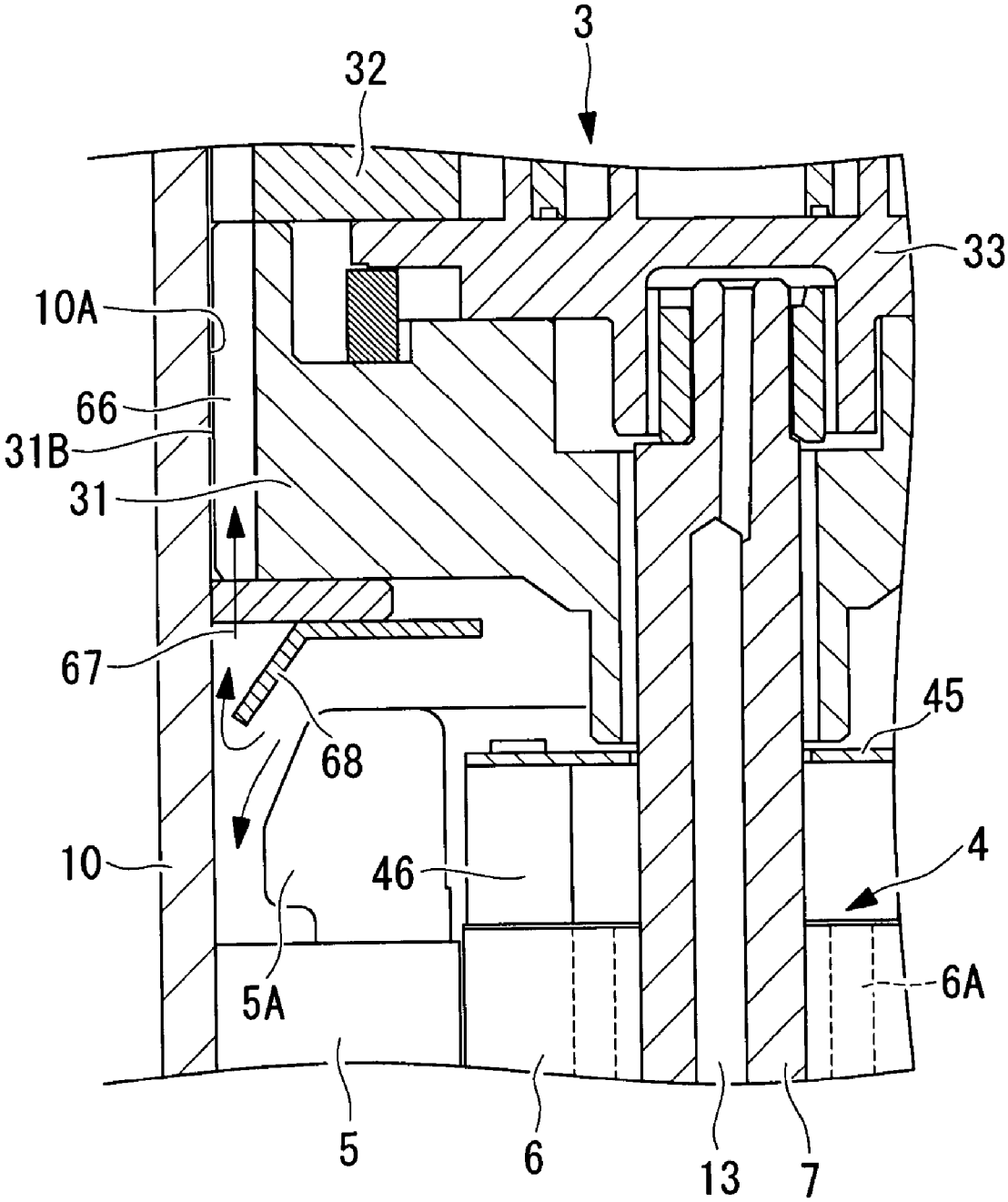
FIG. 9 is an enlarged longitudinal sectional view showing a relevant part of a multistage compressor according to an eighth embodiment of the present invention.

An eighth embodiment of the present invention will now be described with reference to FIG. 9.

This embodiment differs from the third to seventh embodiments in the configuration of a gas channel 66 that guides the intermediate-pressure refrigerant gas to the intake of the high-stage scroll compression mechanism 3. Other points are similar to those in the first to seventh embodiments, and therefore, the descriptions thereof will be omitted.

In this embodiment, the gas channel 66 that guides the intermediate-pressure refrigerant gas to the intake of the high-stage scroll compression mechanism 3 is formed between the outer peripheral surface 31B of the supporting member 31 and the inner peripheral surface 10A of the sealed housing 10, and a downwardly-bent baffle plate 68 is disposed near an inlet 67 of the gas channel 66 by being fixed to the bracket 44.

As described above, the gas channel 66 that guides the intermediate-pressure refrigerant gas to the intake of the high-stage scroll compression mechanism 3 is formed between the outer peripheral surface 31B of the supporting member 31 and the inner peripheral surface 10A of the sealed housing 10, and the downwardly-bent baffle plate 68 is provided near the inlet 67 of the gas channel 66, whereby the flow of intermediate-pressure refrigerant gas flowing towards the inlet 67 of the gas channel 66 can be redirected downward by the downwardly-bent baffle plate 68, as shown with an arrow in the drawing. In this case, the lubricating oil 12 in the intermediate-pressure refrigerant gas keeps flowing downward due to inertia, so as to become separated from the intermediate-pressure refrigerant gas.

By separating the lubricating oil 12 in this manner, the amount of lubricating oil contained in the intermediate-pressure refrigerant gas can be reduced. Thus, the intermediate-pressure refrigerant gas merged with a reduced amount of lubricating oil can be guided to the intake of the high-stage scroll compression mechanism 3 through the gas channel 66. Accordingly, the oil circulation ratio (OCR) of lubricating oil circulating to the refrigeration cycle side can be reduced, thereby improving the system efficiency as well as preventing a shortage of lubricating oil in the compressor.

[Ninth Embodiment]

Figure 10:
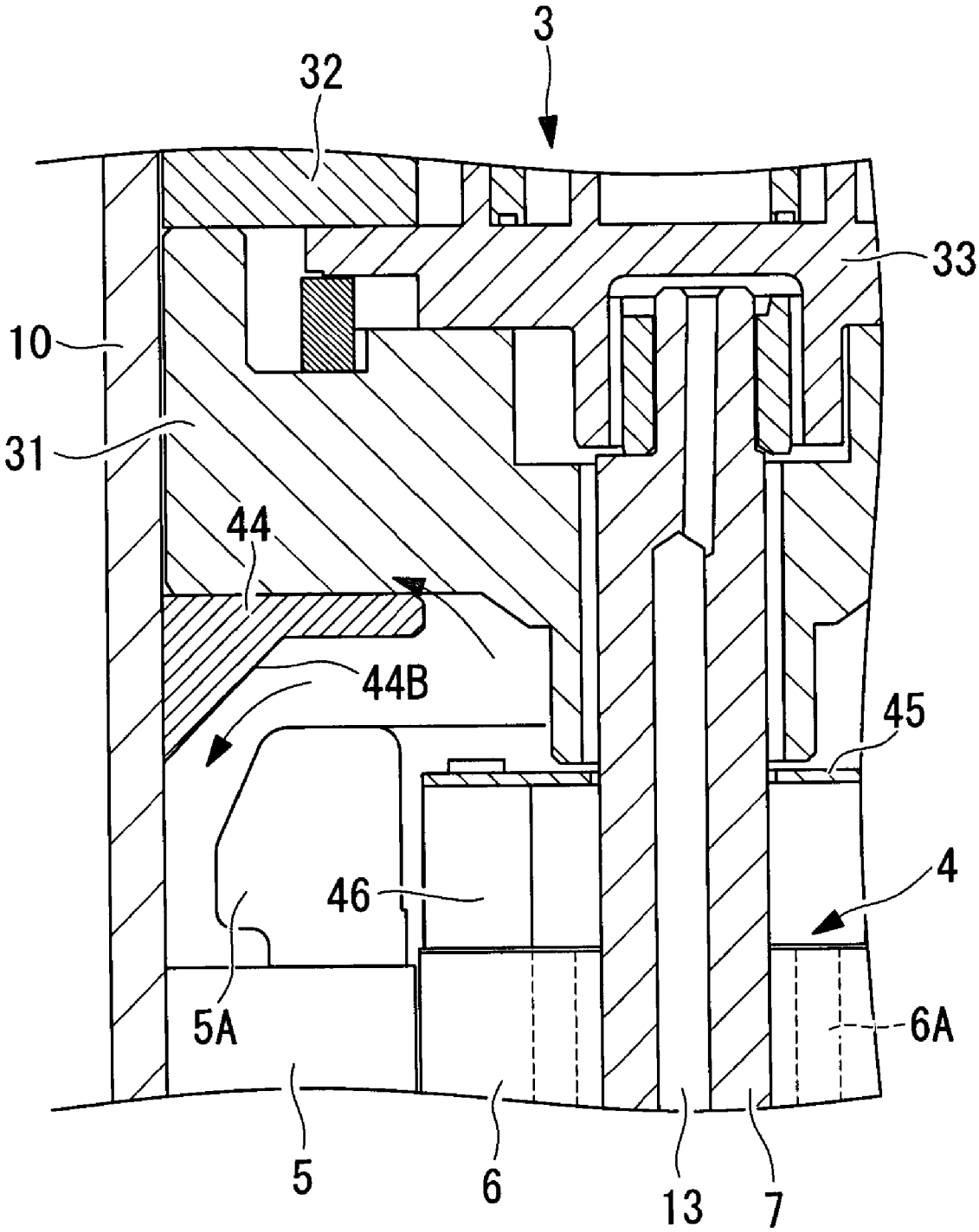
FIG. 10 is an enlarged longitudinal sectional view showing a relevant part of a multistage compressor according to a ninth embodiment of the present invention.

A ninth embodiment of the present invention will now be described with reference to FIG. 10.

This embodiment differs from the first to seventh embodiments partly in the configuration of the bracket 44 that fixes the supporting member 31 in place. Other points are similar to those in the first and seventh embodiments, and therefore, the descriptions thereof will be omitted.

In this embodiment, an outer-peripheral lower surface of the bracket 44 has a downward slope 44B.

As described above, because the outer-peripheral lower surface of the bracket 44 that fixes the supporting member 31 in place has the downward slope 44B, the downward slope 44B exhibits a baffle effect that facilitates the separation of the lubricating oil 12 from the intermediate-pressure refrigerant gas. Thus, the amount of lubricating oil 12 contained in the intermediate-pressure refrigerant gas and to be taken in by the high-stage scroll compression mechanism 3 can be reduced. In addition, since the bracket 44 can be increased in strength, the high-stage scroll compression mechanism 3 can be securely fixed within the sealed housing 10.

The present invention is not limited to the above embodiments, and modifications are permissible to an extent that they do not depart from the scope of the invention. For example, the low-stage compression mechanism 2 and the high-stage compression mechanism 3 constituting the multistage compressor 1 are not limited to the rotary compression mechanism and the scroll compression mechanism described above, and may be other types of compression mechanisms. Furthermore, although a single gas channel that guides the intermediate-pressure refrigerant gas to the intake 55 of the high-stage scroll compression mechanism 3 is provided in the above-described embodiments, since the high-stage scroll compression mechanism 3 has two compression chambers 34 formed at 180° symmetrical positions with respect to the scroll center, two gas channels may be provided so as to correspond to intake cutoff points of the respective compression chambers 34.

The invention claimed is:

1. A multistage compressor, wherein an electric motor is disposed in a substantially central section inside a sealed housing, a low-stage compression mechanism and a high-stage compression mechanism that are driven by the electric motor via a rotary shaft are disposed below and above to flank the electric motor, respectively, intermediate-pressure refrigerant gas compressed by the low-stage compression mechanism is discharged into the sealed housing, and the intermediate-pressure refrigerant gas is taken in by the high-stage compression mechanism so as to be compressed in two stages, wherein an oil separator plate that centrifugally separates lubricating oil contained in the intermediate-pressure refrigerant gas, which is taken in by the high-stage compression mechanism after passing through the electric motor, is provided at one end of a rotor of the electric motor such that the rotary shaft extends through the oil separator plate.

2. The multistage compressor according to claim 1, wherein a through-hole provided in the oil separator plate and through which the rotary shaft extends is provided such that an inner peripheral edge thereof is located closer towards a center than a gas channel hole provided in the rotor.

3. The multistage compressor according to claim 2, wherein a sealing member forms a seal between an inner peripheral surface of the through-hole and an outer peripheral surface of the rotary shaft.

4. The multistage compressor according to claim 1, wherein an inlet of a gas channel that guides the intermediate-pressure refrigerant gas, which passes through the electric motor and flows in between the electric motor and the high-stage compression mechanism, to an intake of the high-stage compression mechanism is provided at an inner peripheral side relative to a stator coil end of the electric motor.

5. The multistage compressor according to claim 4, wherein a section of the gas channel is formed between an outer peripheral surface of a supporting member of the high-stage compression mechanism and an inner peripheral surface of the sealed housing.

6. The multistage compressor according to claim 5, wherein the section of the gas channel formed between the outer peripheral surface of the supporting member and the inner peripheral surface of the sealed housing is sealed from a gap below the section by means of a sealing member.

7. The multistage compressor according to claim 4, wherein a section of the gas channel is formed between a lower surface of a supporting member of the high-stage compression mechanism and an upper surface of a bracket that fixes the supporting member within the sealed housing.

8. The multistage compressor according to claim 7, wherein an inner peripheral edge of the bracket extends toward the inner peripheral side beyond the stator coil end of the electric motor.

9. The multistage compressor according to claim 7, wherein an outer-peripheral lower surface of the bracket has a downward slope.

10. The multistage compressor according to claim 7, wherein the bracket is provided with a plate whose inner peripheral edge extends toward the inner peripheral side beyond the stator coil end of the electric motor.

11. The multistage compressor according to claim 10, wherein an outer peripheral edge of the plate is bent downward to form a slope.

12. The multistage compressor according to any claim 1, wherein a gas channel that guides the intermediate-pressure refrigerant gas, which passes through the electric motor and flows in between the electric motor and the high-stage compression mechanism, to an intake of the high-stage compression mechanism is formed between an outer peripheral surface of a supporting member of the high-stage compression mechanism and an inner peripheral surface of the sealed housing, and wherein a downwardly-bent baffle plate is provided near an inlet of the gas channel.

* * * * *